US006866150B2

(12) United States Patent
Mason et al.

(10) Patent No.: US 6,866,150 B2
(45) Date of Patent: Mar. 15, 2005

(54) CONTAINMENT UNIT FOR PROTECTING MEDICAL SLIDES DURING TRANSIT

(75) Inventors: Hugh Mason, Attleboro, MA (US); Michael J Gruslin, North Attleboro, MA (US); Joseph Winn, Providence, RI (US)

(73) Assignee: The Mason Box Company, Inc., North Attleboro, MA (US)

( * ) Notice: Subject to any disclaimer, the term of this patent is extended or adjusted under 35 U.S.C. 154(b) by 197 days.

(21) Appl. No.: 10/288,926

(22) Filed: Nov. 6, 2002

(65) Prior Publication Data

US 2003/0089634 A1 May 15, 2003

Related U.S. Application Data

(60) Provisional application No. 60/335,495, filed on Nov. 15, 2001.

(51) Int. Cl.[7] ..... B65D 85/48

(52) U.S. Cl. ..... 206/456; 206/485; 206/591; 206/589

(58) Field of Search ..... 206/455, 456, 206/585, 589, 591, 592, 593, 594, 37.1, 37.4, 37.5, 37.8, 37; 383/84, 86; 224/901.2, 901.6; 150/147, 149

(56) References Cited

U.S. PATENT DOCUMENTS

| | | | | | |
|---|---|---|---|---|---|
| 2,176,284 | A | | 10/1939 | Whiteford | 229/14 |
| 3,203,123 | A | | 8/1965 | Dominy | 40/78 |
| 3,235,068 | A | | 2/1966 | Asnes et al. | 206/62 |
| 3,672,490 | A | | 6/1972 | Desmarais et al. | 206/1 R |
| 4,341,331 | A | * | 7/1982 | McDougall | 224/219 |
| 4,523,826 | A | | 6/1985 | Gunduz et al. | 354/337 |
| 4,570,688 | A | * | 2/1986 | Williams | 150/134 |
| 5,024,361 | A | * | 6/1991 | Flowers | 224/223 |
| 5,044,500 | A | | 9/1991 | Webber et al. | 206/456 |
| 5,316,141 | A | * | 5/1994 | Jalomo | 206/320 |
| 5,330,053 | A | * | 7/1994 | Tabuchi et al. | 206/455 |
| 5,392,974 | A | * | 2/1995 | Johnson-Rabbett | 224/674 |
| 5,755,332 | A | * | 5/1998 | Holliday et al. | 206/711 |
| 5,775,508 | A | * | 7/1998 | Bongard et al. | 206/711 |
| 5,799,774 | A | * | 9/1998 | Dengel | 206/38.1 |
| 5,873,456 | A | * | 2/1999 | Hull et al. | 206/38.1 |
| D427,772 | S | * | 7/2000 | Cody | D3/329 |
| 6,588,595 | B2 | * | 7/2003 | Levin et al. | 206/589 |

* cited by examiner

*Primary Examiner*—David T. Fidei
(74) *Attorney, Agent, or Firm*—Edwards & Angell, LLP; Christine C. O'Day; Richard J. Roos

(57) ABSTRACT

A containment unit for protecting fragile objects (e.g., medical slides) during transit is provided, wherein the unit is light weight, yet secure, and such that the objects are securely held in place during transit (e.g., mailing, delivery) to ensure that they are not jostled, intermingled, rearranged, displaced, broken, or otherwise physically harmed/affected.

11 Claims, 4 Drawing Sheets

CONTAINMENT UNIT FOR PROTECTING MEDICAL SLIDES DURING TRANSIT

RELATED APPLICATION(S)

This application claims priority to U.S. Provisional Patent Application Ser. No. 60/335,495, filed Nov. 15, 2001, entitled "Containment Unit For Protecting Medical Slides During Transit," the entire teachings of which are incorporated herein by reference.

FIELD OF THE INVENTION

The present invention relates to containment units, and, more particularly, to light weight, protective containment units in which delicate materials/objects (e.g., medical slides) can be securely held in place during transit (e.g., mailing, delivery) to ensure that they are not jostled, intermingled, rearranged, displaced, broken, or otherwise physically harmed/affected.

BACKGROUND OF THE INVENTION

In today's society, many highly delicate objects/materials must be delivered to remotely located recipients. This generally necessitates entrusting parcels that contain such objects to another entity (e.g., a messenger, postal or parcel service) for actual delivery thereof. Unfortunately, the majority of such entities operate in a manner wherein they are unable to ensure that such parcels are not physically damaged during transit.

As such, those who send such objects have been forced to take steps to package them in a manner that provides the most protection against physical damage in transit. Usually, this consists of wrapping the contents with one or more of the numerous commercially available packing materials such as so-called "bubble wrap," and/or surrounding the contents with so-called "packing peanuts." Such protection also can be offered by wrapping the contents in a towel, some used newspaper and/or other household materials.

While these packing options often are effective to protect such objects from being damaged in transit, they have several drawbacks. For example, they tend to create a mess and/or endanger the fragile objects during the (un)packing process, and they do not provide the ability to maintain the objects in a predetermined order and/or orientation during transit.

While, arguably, this latter drawback may not be an important consideration during delivery of all fragile/delicate items, there are some objects that must be packaged such that not only are they not broken or harmed during transit, but also such that they are not rearranged or displaced from their pre-delivery order/orientation.

Among such items are those that contain medical information, such as medical slides. Currently, there exist two popular slide-holding units (shown, respectively, in FIGS. 1 and 2) in which medical slides are placed during delivery. Both of these units provide somewhat adequate assurance that slides will arrive in the same order and orientation as when they were sent, but, unfortunately, suffer from many significant drawbacks.

Perhaps most significantly, neither unit can be mailed "as is"—that is, these units are of a shape, color and/or texture such that they cannot be mailed without first being placed into a separate mailing unit or without being wrapped with paper. Additionally, neither unit provides much, if any cushioning of the slides. In fact, each unit is designed such that a significant amount of space exists between the top of the unit and the slides contained therein. This readily allows for unwanted jostling of the slides during transit, which, in turn, could physically damage the slides.

Other problems arise due to the number of slides that can be held in each unit. For example, the unit of FIG. 1 can only hold up to five slides, thus requiring use of multiple units to deliver additional slides. And because the units are visually identical, use of multiple units in the same parcel provides an opportunity for confusion as to which slides are in which units.

On the other hand, the unit of FIG. 2 holds up to 100 slides. And while, on occasion, it may be necessary to hold that many slides in one parcel, most parcels generally only require space to hold a few dozen slides. Because of its capacity, the unit of FIG. 2 is quite large and rather heavy, thus likely requiring extra fees for postage/delivery as compared to smaller, lighter units.

Moreover, neither of these units provides a reasonable amount of cushioning for its contents during transit. Thus, they are forced to be wrapped with "bubble wrap," packed with "packing peanuts," and/or surrounded by a newspaper or towel in an attempt to provide such cushioning. Such efforts certainly add to the expense of the delivery process, as well as to the time, effort, mess and risk of damage to the objects during (un)packing, yet often do not even provide the desired level of cushioning.

Other known holding units, such as those depicted and described in U.S. Pat. Nos. 2,176,284, 3,203,123, 3,235,068, 3,672,490, 4,523,826, and 5,044,500, suffer from these and/or other problems that also render their use impractical, expensive, unsafe, or otherwise contraindicated.

Therefore, a need exists for a light weight, protective containment unit in which fragile/delicate objects (e.g. medical slides) can be securely stored during transit wherein the unit is designed such that objects contained therein are ensured not to break or to be otherwise harmed or adversely physically affected in transit, and further ensured not to be jostled, rearranged, intermingled or otherwise displaced from their pre-transit order and/or orientation.

It is therefore an object of the present invention to provide a containment unit that is designed such that its contents are ensured not to broken or otherwise harmed during transit, and such that the order/orientation of the contents is maintained during transit.

It would also be desirable to provide such a containment unit that is light weight, wherein extra postage and/or other fees are not incurred for delivery thereof, and made of inexpensive materials that are sturdy enough to ensure the structural integrity of the unit during most, if not all foreseeable transit conditions.

Moreover, it would be useful for such a containment unit to be relatively quick and simple to both assemble and/disassemble.

It would further be desirable to provide such a mailing unit that can be mailed "as is"—that is, wherein the unit is not required to be packaged in one or more additional packages/materials in order to be suitable for transit.

SUMMARY OF THE INVENTION

These and further and other objects and features of the invention are apparent in the disclosure, which includes the above and ongoing written specification, with the claims and the drawings.

The present invention relates to a light weight, protective containment unit in which delicate materials/objects can be securely held in place during transit to ensure that they are not jostled, intermingled, rearranged, displaced, broken, or otherwise physically harmed/affected. While the containment unit is primarily described as being suitable for holding medical slides during mailing, it should be understood that the containment unit may be utilized to hold any delicate or fragile materials or objects during any form of transit or delivery.

In an exemplary aspect thereof, the present invention relates to a containment unit for delicate objects that comprises a receptacle with a bottom surface and a plurality of walls extending vertically from the bottom surface to define an opening in the receptacle, a holding element that is sized to fit within the opening of the receptacle, and that includes a bottom surface with at plurality of walls extending vertically therefrom to define an opening in the holding element, a predetermined number of protrusions that protrude from at least one of the plurality of walls to define slots within the opening of the holding element, the slots being sized and shaped to hold the objects; and at least one supporting leg protruding from the bottom surface of the holding element. The containment unit also includes a topping element having a top surface and a plurality of walls extending vertically therefrom to define an opening in the receptacle, wherein the topping element is sized to fit atop the receptacle.

Generally, the containment unit also includes at least one cushioning element, which may be placed in several locations including, but not limited to atop the walls of the holding element, and/or between the bottom surface of the receptacle and the at least one supporting leg of the holding element.

Optionally, one or more hinge or fastening elements may protrude from one or more of the walls of the receptacle. In such an aspect of the invention, these elements fit into openings in the topping element such that once the topping element is placed atop the receptacle, the elements can be maneuvered to provide added assurance that the assembled containment unit will remained closed during transit.

Still other aspects and embodiments of the present invention are discussed in detail below.

BRIEF DESCRIPTION OF THE DRAWINGS

For a fuller understanding of the nature and desired objects of the present invention, reference is made to the following detailed description taken in conjunction with the accompanying drawing figures wherein like reference characters denote corresponding parts throughout the several views, and wherein.

DETAILED DESCRIPTION OF THE INVENTION

The present invention provides a novel and highly useful containment unit in which delicate materials/objects (e.g., medical slides) can be securely held in place during transit (e.g., mailing, delivery) to ensure that they are not jostled, intermingled, rearranged, displaced, broken, or otherwise physically harmed/affected.

Figure 3:
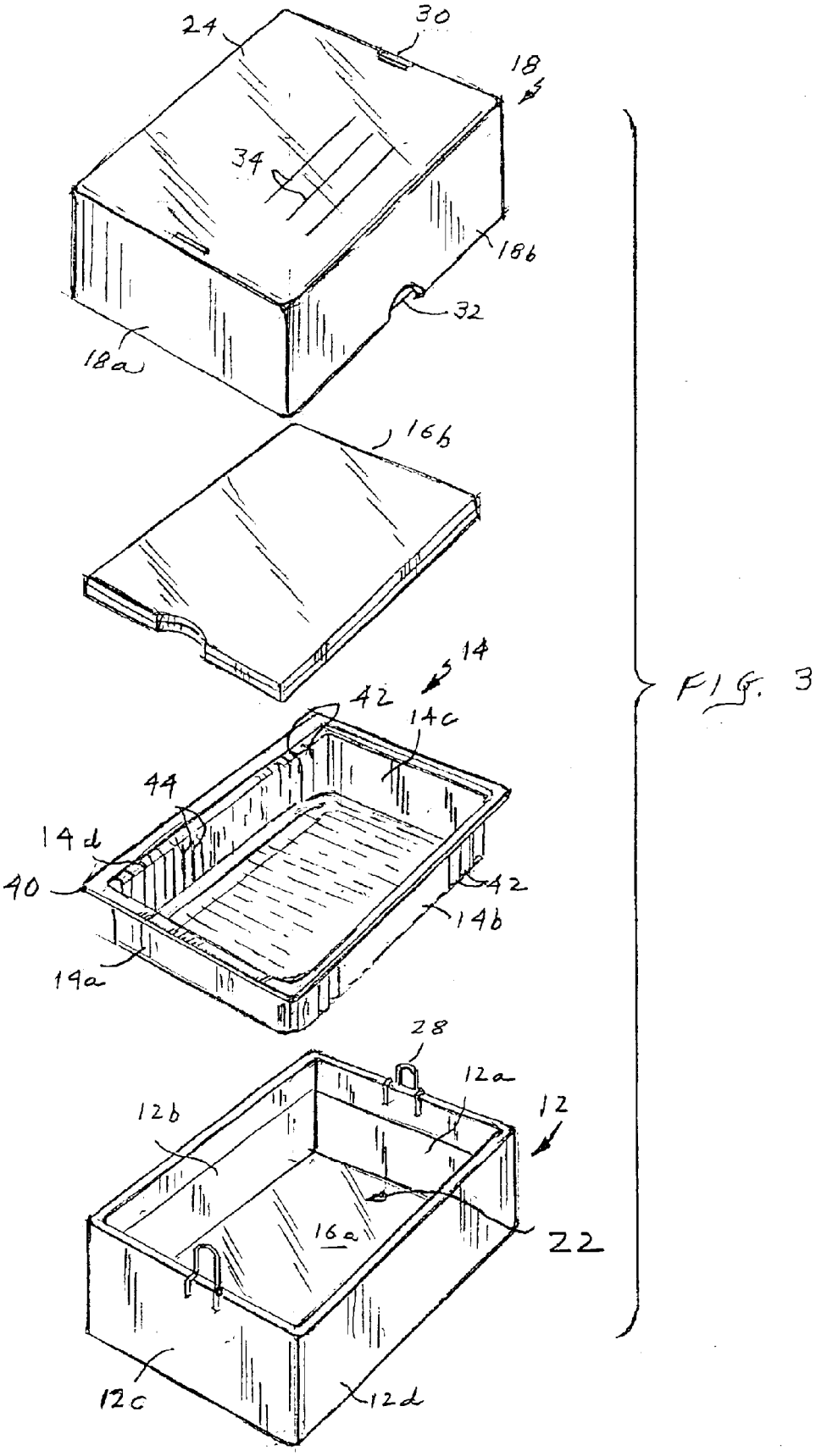
FIG. 3 is an exploded view of one embodiment of the containment unit of the present invention.
Figure 4:
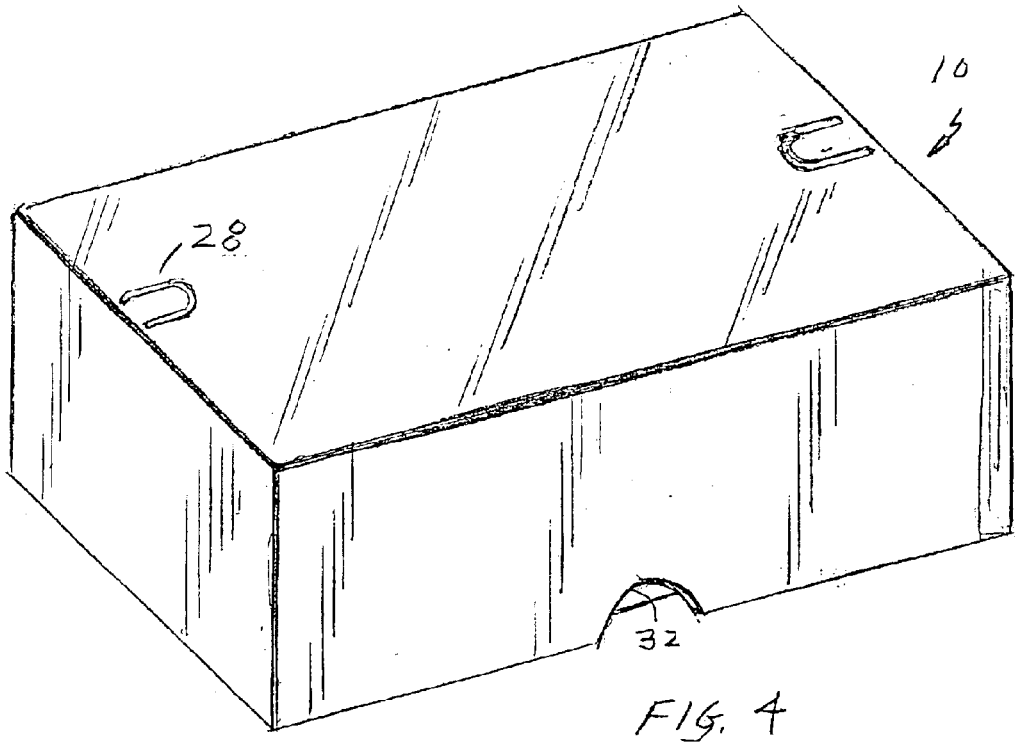
FIG. 4 shows the containment unit of FIG. 3 in assembled form.

An exemplary containment unit 10 is shown in FIG. 3 in an exploded view, and in FIG. 4 in an assembled form. The unit 10 includes a receptacle 12, in which a holding unit 14, and one or more cushioning elements 16 fit, and atop which a topping element 18 is placed to form an assembled unit.

The receptacle 12 and topping element 18 are shown in detail in FIG. 3. Generally, the receptacle 12 and the topping element 18 are identically dimensioned, and are formed of the same material, although they may be differently dimensioned and/or formed of different material without departing from the scope of the present invention.

The receptacle 12 includes a bottom surface 20 and a plurality of walls 12*a*, 12*b*, 12*c*, 12*d* that extend vertically therefrom to define an opening 22 therewithin, while the topping element 18 includes a top surface 24 and a plurality of walls 18*a*, 18*b*, 18*c*, 18*d* that extend vertically therefrom to define an opening 26 therewithin.

Either or both the receptacle 12 and/or the topping element 18 may instead include one continuous circumferential wall if, for example, the bottom surface 20 of the receptacle and/or the top surface 24 of the topping element 18 is round or oval shaped. Generally, however, both the bottom surface 20 of the receptacle 12 and the top surface 24 of the topping element 18 are shaped like a parallelogram (e.g., a rectangle or square) and, therefore, include as many as four walls 12*a*, 12*b*, 12*c*, 12*d* and 18*a*, 18*b*, 18*c*, 18*d*.

As noted above, the receptacle 12 and the topping element 18 generally are identically dimensioned and formed of the same material. While the specific dimensions thereof depend on the objects that will be placed therein, as well as the envisioned mode of delivery of the containment unit 10, certain dimensions and material formations are generally used.

In an exemplary embodiment of the present invention, both the bottom surface 20 of the receptacle 12 and the top surface 24 of the topping element 18 are rectangular in shape, with a length, L, in the range of about 2 inches to about 12 inches, preferably about 3 inches to about 8 inches, most preferably about 5 inches to 6 inches, and a width, W, in the range of about 1 inch to 8 inches, preferably about 2 inches to 5 inches, most preferably about 3 inches to 4 inches.

In such an embodiment, each of the walls 12*a*–12*d*, 18*a*–18*d* of the receptacle 12 and the topping element 18 extend vertically by a distance, D, from, respectively, the bottom surface 20 of the receptacle and the top surface 24 of the topping element. Generally, but not necessarily, this distance, D, is substantially identical for each of the walls 12*a*–12*d*, 18*a*–18*d*.

In an exemplary embodiment of the present invention, this distance, D, is in the range of about 0.5 inch to 6 inches, preferably about 1 inch to 3 inches, most preferably about 1.5 inch to about 2.5 inches.

The length/width of each of the walls 12*a*–12*d*, 18*a*–18*d* is generally identical to the length/width of the side of the bottom surface 20 of the receptacle 12 or the side of the top surface 24 of the topping element 18 from which the wall extends.

The topping element 18 is sized and shaped to be fit atop the receptacle 12 such that the walls 12*a*–12*d* of the receptacle abut the top surface 24 of the topping element, and also such that the walls 18*a*–18*d* of the topping element abut the bottom surface 20 of the receptacle.

Because of the openings 22, 26 defined, respectively, in the receptacle 12 and the topping element 18, an open space (not shown) is defined within the receptacle and topping element, and is secured (i.e., enclosed) by the walls 12*a*–12*d*, 18*a*–18*d* thereof. The remainder of the components of the containment unit 10 occupy this open space as will be discussed below.

The receptacle 12 may include one or more securing elements 28, which operate in conjunction with openings in the topping element 18 to provide added assurance that the containment unit 10, once closed, will remain closed.

Generally, each securing element 28 protrudes from a wall 12*a*, 12*b*, 12*c*, 12*d* of the receptacle 12. For example, in the embodiment of the invention shown in FIG. 3, two such securing elements 28 are included and protrude from walls 12*a*, 12*c*. The number of securing elements 28 can vary without departing from the scope of the present invention. By way of non-limiting example, the number of securing elements 28 that are present is generally in the range of 1 to 8, preferably in the range of 2 to 4, most preferably 2.

The securing elements 28 can protrude from any area of any wall 12*a*–12*d* of the receptacle 12, but generally protrude from the approximate midpoint of the length/width of each wall, as shown in FIG. 3. The securing elements 28 may protrude from other areas of the wall, however, without departing from the scope of the present invention.

The securing elements 28 are attached to the wall (as is generally known in the art) of the receptacle 12 from which they protrude. Each securing element 28 generally vertically protrudes from a receptacle wall by an identical distance, which, in an exemplary embodiment of the present invention, is in the range of about 0.1 inch to about 1 inch, preferably about 0.2 inch to 0.5 inch, most preferably about 0.25 inch. The width of each securing element 28 is generally substantially equal to the distance that the securing element 28 vertically protrudes from the wall, but may also be greater than or less than this protruding distance.

The securing elements 28 should be made of an inexpensive, yet durable material that can be readily bent and unbent (without breaking) in order to stay in place (i.e., without automatically returning to its (un) bent state without being acted upon by an external force). In an exemplary embodiment of the present invention, each of the securing elements are made of a malleable metal/alloy wire.

In order to accommodate the securing elements 28, the topping element 18 includes properly positioned holes 30 (see FIG. 3) defined in its top surface 24. The width and length of these holes 30, as well as their position with respect to the top surface of the topping element 18, should be such that the securing element(s) 28, when bent to be substantially parallel to the receptacle wall(s) from which it/they protrude (see FIG. 3), can fit within the hole(s).

Once the topping element 18 has been placed atop the receptacle 12 such that the securing element(s) 28 fit through the holes 30, the securing element can be bent approximately 90° such that they abut the outer portion of the top surface 24 of the topping element (see FIG. 4). After that occurs, the topping element 18 and receptacle 12 are reliably, yet reversably secured together without requiring glue, tape or other adhesives that are messy and take time to put in place and, especially, to remove.

In another alternate embodiment, the topping element 18 also includes at least one finger slot 32 (see FIG. 3) to allow for simplified removal of the topping element from the receptacle 12. The number of slots 32 that are included (and/or their shape) may vary in accordance with the invention. Generally, however, the number of slots 32 included is in the range of 1 to 8, preferably 2 to 4, most preferably 2.

The slots 32 may have a variety of shapes, and may be identically or differently shaped. Preferably, the slots 30 are shaped to accommodate an adult's digit (i.e., finger or thumb). Currently, an arch (i.e., half-circle) shape is preferred for the slots 32. In such an embodiment, each slot 32 has a diameter (i.e., length) in the range of about 0.25 inch to 1.5 inch, preferably about 0.5 inch to about 1 inch, most preferably about 0.75 inch. Thus, the radius (i.e., height) of each slot 32 will be equal to half the value of the diameter.

An individual, in furtherance of unpacking the containment unit 10, can insert one or more of his/her fingers into these slots to facilitate the removal of the topping element 18 from atop the receptacle 12.

Figure 1:
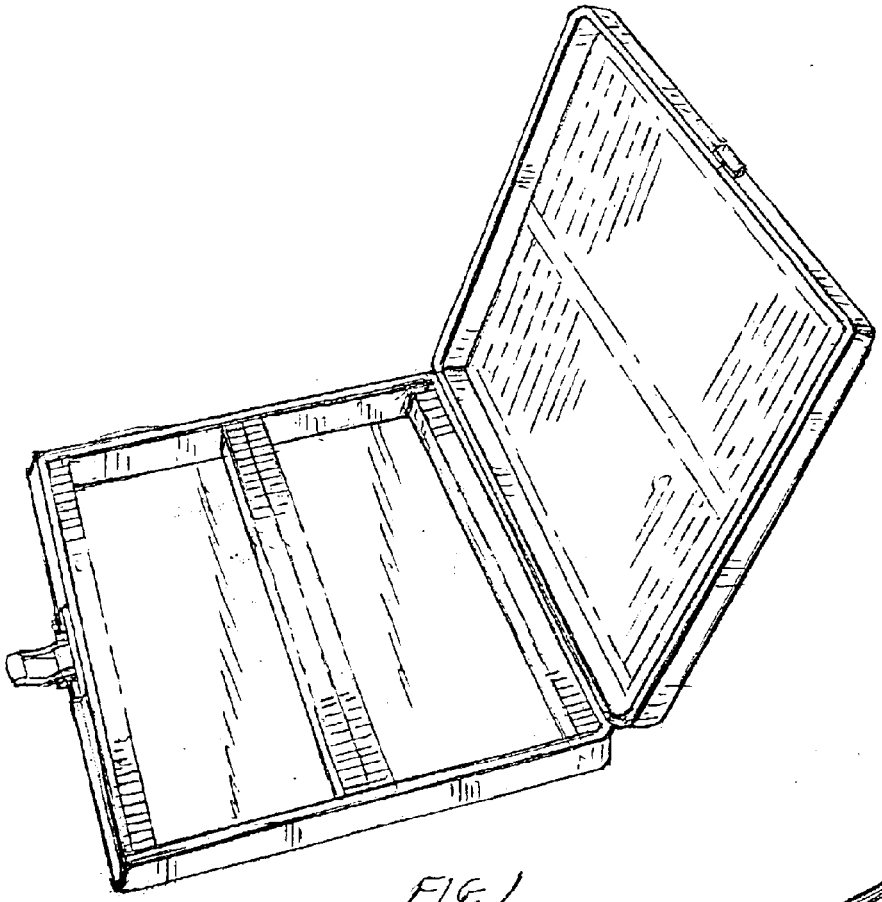
FIGS. 1 and 2 are schematic views of two prior art medical slide containment units.
Figure 2:
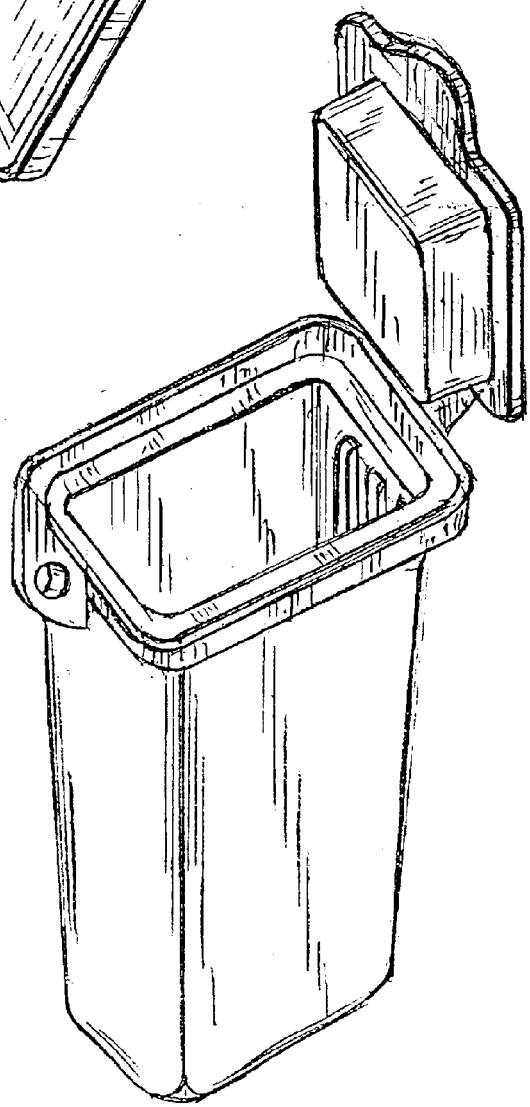

The receptacle 12 and topping element 18 are generally made of identical materials (e.g., cardboard) that are structurally sturdy, yet not unduly heavy and, preferably, that can be transmitted through the mail "as is" (i.e., without being placed in a separate parcel in order to be capable of having address information written thereupon or applied thereto, and/or of having stamps/postage affixed thereto). This "as is" quality renders the containment unit 10 of the present invention advantageous as compared to conventional units (see FIGS. 1 and 2), which must be placed in separate parcels in order to be mailed/delivered.

In order to add to its "as is" quality, the topping element 18 can include one or more addressee/addressor grids 34 (see FIG. 3) on its outer surface, and on which addressee/addressor labels can be placed, or on which such information can be written.

In an exemplary embodiment of the present invention, a receptacle 12 and a topping element 18 that have dimensions of about 5.35 inches long, 3.75 inches wide, and 2.75 inches deep are made of a material with a weight of about 0.05 pounds. Of course, this exemplary weight will necessarily change if/when there is a change in these exemplary dimensions.

Referring now to FIG. 3, a holding element 14 for delicate/fragile objects is shown. This particular unit is sized and shaped to hold delicate medical slides, but it is understood that the holding element may be sized shaped to hold numerous different types of fragile/delicate objects.

The holding element 14 has a bottom surface 36 from which a plurality of walls 14*a*, 14*b*, 14*c*, 14*d* vertically extend to define an opening 38 therewithin. Alternatively, the holding element may instead include one continuous circumferential wall if, for example, the bottom surface 36 thereof is round or oval shaped.

Generally, however, the bottom surface 36 of the holding element 14 is shaped like a parallelogram (e.g., a rectangle or square) and, therefore, includes as many as four walls 14*a*, 14*b*, 14*c*, 14*d*.

Each wall of the holding element 14 has a length and a width that are less than, respectively, the length and width of corresponding/facing walls 12*a*–12*d* of the receptacle 12. This not only allows the holding element 14 to be placed within the opening 22 of the receptacle 12, but ensures that the walls of the holding element are not in physical contact with the walls of the receptacle 12. That, in turn, provides added assurance that any force directed against the receptacle 12 either will not be transferred to the holding element (and, thus, its contents), or will be transferred in lower, less potentially harmful amounts, such that the fragile/delicate contents of the holding element are less likely to be broken or otherwise physically harmed or adversely affected.

In order to ensure that the holding element 14 is not jostled when placed within the receptacle, it generally includes a surrounding lip 40, which has dimensions such that it rests directly against the walls 12*a*–12*d* of the receptacle 12. This lip 40 also may additionally function as a resting place for a cushioning element, as will be explained below.

In order to securely hold fragile/delicate objects, the holding element 14 includes a plurality of protrusions 42 from parallel walls of the holding element. These protrusions 42 define slots 44 or other holding areas in which the objects may be placed.

In the embodiment of FIG. 3, for example, the protrusions 42 are from the longer walls 14*b*, 14*d* of the holding element 14. It is understood, however, that the protrusions 42 may instead protrude from the shorter walls 14*a*, 14*c* of the holding element 14. Optionally, additional protrusions 42 may protrude from the bottom surface 36 of the holding element 14.

Collectively, these protrusions 42 define a plurality of slots 42 or holding areas in which medical slides or other delicate/fragile objects can be inserted and securely held in place. The protrusions 42 are spaced apart from each other by a distance that allow the slides to be easily inserted therein, but that guard against any significant side-to-side movement of the slides following their placement. The number of slots/areas 44 defined by the protrusions 42 may vary. Generally, the number of slots/areas 44 is in the range of about 5 to 100, preferably about 10 to 50, most preferably about 20 to 30.

The holding element 14 generally includes a slide placement identification facilitation system in order to keep track of the slides and their contents. In an exemplary embodiment of the present invention, this system is a numbering system whereby a number is written on, or defined within a portion of the lip 40 of the holding element 14. This number corresponds to the number of the slide/object that is inserted in the slot/area 44 that is located closest to the number.

Other identification systems may include, but are not limited to, color-based identification systems (e.g., wherein certain protrusions are color-coded to assist in identifying slides).

In order to provide further assurance against damage to the slides/objects contained therewithin, the bottom surface 36 of the holding element 14 should not rest directly against the bottom surface 20 of the receptacle 12. Thus, in an exemplary embodiment of the invention, the holding element 14 is generally equipped with one or more elevating legs 46 to create a distance between the bottom surface 20 of the receptacle 12 and the bottom surface 36 of the holding element.

The number of elevating legs 46 included may vary, as may their height. Generally the number of such legs 46 is in the range of 1 to 8, preferably 2 to 4, most preferably 2.The shape of the each leg 46 is preferably (but not necessarily) identical.

Generally, the legs 46 have a height that elevates the bottom surface 38 of the holding element 14 from the bottom surface 20 of the receptacle 12 by a distance in the range of about 0.1 inch to 1.0 inch, preferably about 0.25 inch to about 0.75 inch, most preferably about 0.5 inch.

Figure 5:
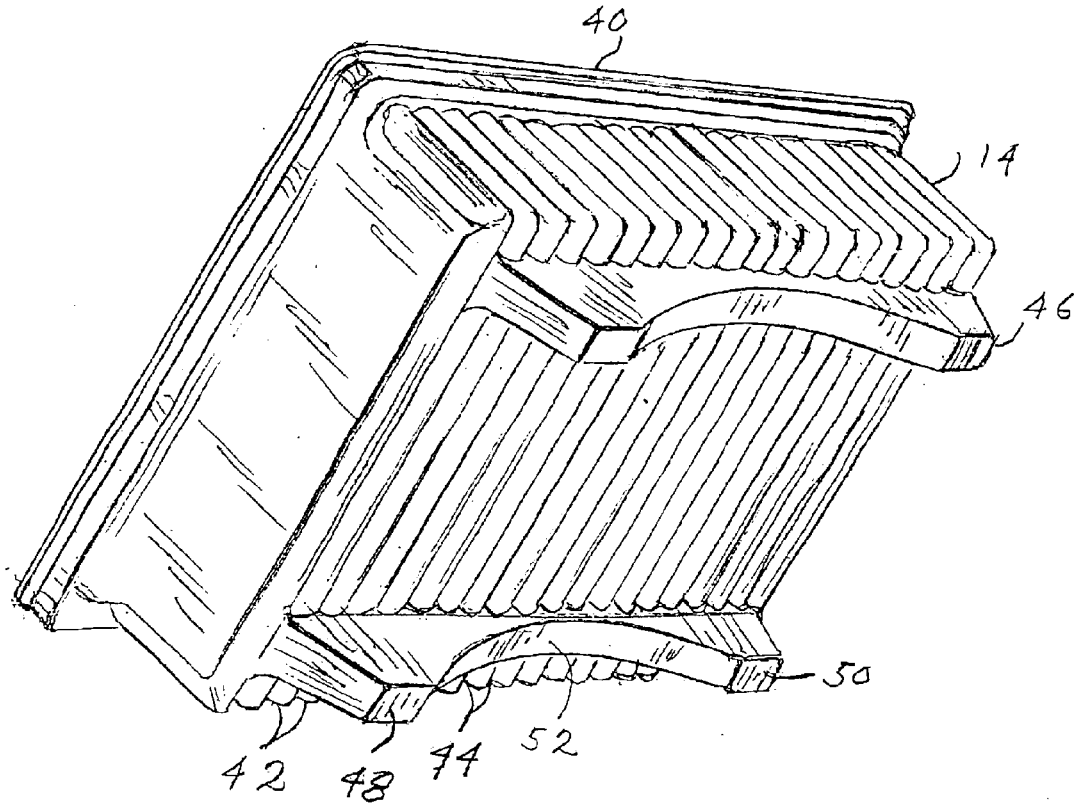
FIG. 5 shows the underside of a receptacle.
Figure 6:
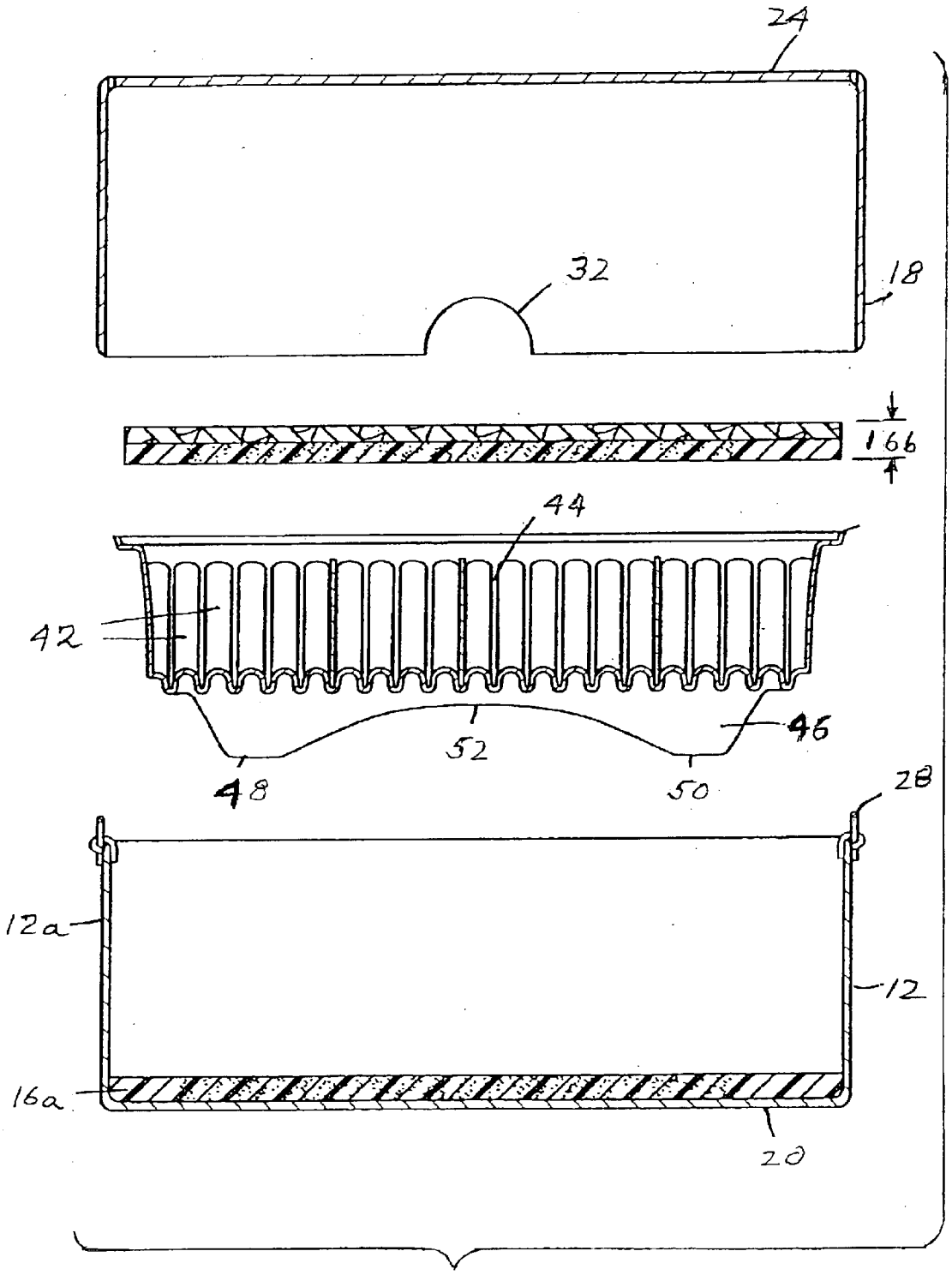
FIG. 6 is an exploded cross-sectional view of the containment unit of FIG. 3.

The legs 46 may have many suitable shapes. One currently preferred shape is shown in FIG. 5. This shape includes two flattened portions 48, 50 that rest directly against the bottom surface 20 of the receptacle 12, and an arch-shaped middle area 52 between the flattened portions.

Such a shape has been found to be especially effective in protecting the contents of the holding element 14 from breakage due to external forces being applied to the receptacle 12, especially those forces that are concentrated upon the bottom surface 20 of the receptacle.

The holding element 14 may be made of many different types of materials. Preferred materials are those that offer impact resistance, chemical resistance, and that can be readily shaped/molded during formation to include the protrusions 42 and legs 46 described above and depicted at FIG. 5. Examples of suitable materials include, but are not limited to plastics. A currently preferred plastic is polyvinyl chloride film. Such film is available from many commercial suppliers, including, but not limited to, Nan Ya Plastics Corporation, USA of Wharton, Tex., which supplies a preferred polyvinyl chloride film known as "BVDC film."

In order to provide still further protection to the slides/objects contained within the holding element 18, one or more cushioning elements 16 may be placed atop and/or below the holding element. Exemplary locations for placement of cushioning elements 16 include, but are not limited to, (1) between the bottom surface 20 of the receptacle 12 and the legs 46 of the holding element 14, and/or (2) atop the holding element within its lip 40, and/or (3) between a wall of the receptacle 12 and a wall of the holding element.

Generally, two cushioning elements 16 are included, one in each of these exemplary placement locations. The first cushioning element 16*a* that is placed between the bottom surface 20 of the receptacle 12 and the legs 46 of the holding element 14 is generally made of a polymeric foam in order to dampen any forces exerted against the bottom surface of the receptacle, but may be made of other materials that serve a similar purpose.

The second cushioning element 16*b* that is placed atop the holding element within its lip 40 is preferably made of a polymeric foam that is attached (e.g., laminated) to a backing sheet of cardboard or thick stock paper. The foam side of the element 16*b* rests atop the lip 40 of the holding element 14, while the backing sheet side of the element faces the other direction, against which the top surface 24 of the topping element 18. The presence of this element 16*b* provides further assurance that the objects contained held within the slots/holding areas 44 of the holding unit 14 will not be jostled during transit.

Alternatively, the second cushioning element 16*b* may be made entirely of a polymeric foam, or of another material that serves a similar purpose.

Both the first cushioning element have dimensions that closely resemble those of the walls 12*a*–12*d*, 18*a*–18*d* of the receptacle 12 and the topping element 18 in order to fit snuggly therewithin.

In an exemplary embodiment of the present invention, fragile/delicate materials are prepared for delivery by being placed in a containment unit 10 as follows. The receptacle 12 is oriented such that its walls are pointed upwards. The first cushioning element 16*a*, if included, is then placed within the receptacle 12 such that it lies against the bottom surface 20 of the receptacle. The holding element 14 is then placed within the receptacle 12 such that its legs 46 are in contact with the first cushioning element 16*a* (or, if the first cushioning element is not included, such that its legs are in contact with the bottom surface 20 of the receptacle).

The objects, if not already loaded in the holding element 14, are placed within the holding element at this time. Then, the second cushioning element 16*b*, if included, is then placed atop the holding element 14 such that its foam side is within the lip 40 of the unit, and such that its cardboard side faces upward.

At this time, it should be verified that the securing element(s) 28 if included, is/are pointed in a direction parallel to the walls 12*a*, 12*c* from which they extend. If not, they should be so oriented.

The topping element 18 is then placed atop the assembly such that the top surface 24 of the topping element is in contact with the second cushioning element 16*b* (or, if the second cushioning element is not included, such that its top surface is in contact with the lip 40 of the holding element 14).

The securing elements 28 are then bent such that they abut the topping element 18 in order to secure the receptacle 12 to the topping element and, in turn, to secure in place the slides/objects within the containment unit 10. Information such as addressee, addressor, postage, fragility warnings may then be added (e.g., written on and/or affixed to the grid(s) 34) to the topping element, after which the containment unit 10 is ready to be delivered to its destination.

The invention has been described in detail with particular references to the preferred embodiment(s) thereof. It will be appreciated, however, that modifications and improvements within the spirit and scope of this invention may be made by those skilled in the art upon considering the present disclosure.

What is claimed is:

1. A containment unit for delicate objects, comprising:

a receptacle having a bottom surface and a plurality of walls extending therefrom to define an opening in the receptacle, the receptacle further including at least one securing element that protrudes from one of the plurality of walls;

a holding element sized to fit within the opening of the receptacle, the holding element including:

a bottom surface with a plurality of walls extending therefrom to define an opening in the holding element;

a predetermined number of protrusions that protrude from at least one of the plurality of walls to define slots within the opening of the holding element, the slots being sized and shaped to hold the objects;

at least one supporting leg protruding from the bottom surface of the holding element; and a topping element having a top surface and a plurality of walls extending therefrom to define an opening in the receptacle, wherein the topping element is sized to fit atop the receptacle, and wherein at least one opening is defined in the top surface of the topping element such that each of the at least one securing element is sized to fit within one of the at least one opening defined in the top surface of the topping element.

2. The containment unit of claim 1, further comprising:

at least one cushioning element placed in a predetermined area within the containment unit.

3. The containment unit of claim 2, wherein the predetermined area is selected from the group consisting of (1) atop the walls of the holding element, (2) between the bottom surface of the receptacle and the at least one supporting leg of the holding element (3) between a wall of the receptacle and a wall of the holding element.

4. The containment unit of claim 2, wherein the containment unit includes two cushioning elements.

5. The containment unit of claim 4, wherein a first of the two cushioning elements is placed atop the walls of the holding element, and a second of the cushioning elements is placed between the bottom surface of the receptacle and the at least one supporting leg of the holding element.

6. The containment unit of claim 1, wherein the bottom surface of the receptacle and the top surface of the topping element are parallelogram-shaped.

7. The containment unit of claim 6, wherein each of the receptacle and the topping element include four walls, each of the walls of the receptacle vertically extending from a different side of the parallelogram-shaped bottom surface of the receptacle, and each of the walls of the topping element vertically extending from a different side of the parallelogram-shaped top surface of the topping element.

8. The containment unit of claim 1, wherein at least one of the plurality of walls of the topping element includes a slot sized to accommodate a human digit.

9. The containment unit of claim 1, wherein the top surface of the topping element includes a grid for placement of information.

10. The containment unit of claim 1, wherein the holding element is made of a plastic material.

11. The containment unit of claim 10, wherein the holding element is made of a polyvinyl chloride material.

* * * * *